US007226392B2

(12) United States Patent
Hong

(10) Patent No.: US 7,226,392 B2
(45) Date of Patent: Jun. 5, 2007

(54) FITNESS MACHINE WITH ELLIPTICAL AND STEPPING FUNCTIONS

(76) Inventor: Chou Hong, No. 17, Renhe Rd., Nangang Ind. Zone, Nantou County 540 (TW)

( * ) Notice: Subject to any disclaimer, the term of this patent is extended or adjusted under 35 U.S.C. 154(b) by 0 days.

(21) Appl. No.: 11/320,310

(22) Filed: Dec. 27, 2005

(65) Prior Publication Data

US 2007/0032348 A1 Feb. 8, 2007

(30) Foreign Application Priority Data

Aug. 4, 2005 (TW) ..... 094213304 U

(51) Int. Cl.
*A63B 22/00* (2006.01)

(52) U.S. Cl. ..... 482/52; 482/57

(58) Field of Classification Search ..... 482/51–53, 482/57

See application file for complete search history.

(56) References Cited

U.S. PATENT DOCUMENTS 6,152,859 A * 11/2000 Stearns ..... 482/52
6,196,948 B1 * 3/2001 Stearns et al. ..... 482/52
6,485,395 B1 * 11/2002 Stearns et al. ..... 482/57
6,569,061 B2 * 5/2003 Stearns et al. ..... 482/52
7,014,597 B2 * 3/2006 Tsai ..... 482/52
7,044,893 B2 * 5/2006 Tsai ..... 482/52
7,121,984 B1 * 10/2006 Hong ..... 482/52

* cited by examiner

*Primary Examiner*—Stephen R. Crow
(74) *Attorney, Agent, or Firm*—Charles E. Baxley

(57) ABSTRACT

The present invention discloses a fitness machine with elliptical and stepping functions for integrating a stepping exercise and an elliptic exercise for exercising users' legs as well as a swing exercise for exercising users' arms. The fitness machine comprises a frame, two sliding rods, two pedals, and two support rods. If the two support rods are fixed to the frame, the two pedals will be limited such that the two pedals produce an up-and-down stepping exercise. If the two support rods are fixed to the sliding rods, then the limiting effect of the pedals provided by the support rods will be diminished, so that the two pedals produce a back-and-forth elliptic exercise. Regardless of the stepping exercise or the elliptic exercise, the two swinging arms are linked by the two sliding rods and swung back and forth, so as to provide both exercisers for legs and arms.

16 Claims, 9 Drawing Sheets

FITNESS MACHINE WITH ELLIPTICAL AND STEPPING FUNCTIONS

FIELD OF THE INVENTION

The present invention relates to a fitness machine with elliptical and stepping functions, and more particularly to a fitness machine that allows users to select a stepping exercise or an elliptical exercise to do exercise for both legs and hands.

BACKGROUND OF THE INVENTION

Referring to FIGS. 10 and 11 for a prior art fitness machine concurrently providing a stepping exercise and an elliptic exercise, the fitness machine comprises a frame 70, a connecting mechanism 90, and two stepping rods 80, and the frame 70 is pivotally coupled to the front end of the two stepping rods 80, and the rear end of the two stepping rods 80 limit an up-and-down movement by a connecting mechanism 90 on the frame 70, characterized in that the frame 70 is divided into several sections of pipes, and the pipes are pivotally coupled to each other, and each pipe is connected and fixed in a position by a movable fixing pin; the connecting mechanism 90 is a set of mechanisms for performing a circular movement with respect to the frame 70, and both sides include two corresponding circular turning rotating rods 91, and the two rotating rods 91 separately utilize the sliding rod 92 to be slidably installed onto the stepping rod 80; the front ends of the two sliding stepping bases 81 are slidably disposed on the stepping rod 80, and the sliding stepping base 81 is selectively fixed onto the stepping rod 80 or the connecting mechanism 90 is slidably fixed onto the stepping rod 80, such that the sliding stepping base 81 can provide both stepping exercise and elliptic exercise.

In the foregoing structure, the fitness machine provides both stepping and elliptic exercisers as described below:

For the elliptic exercise, a screw rod 83 is passed through a locking rod 82 and locked to a screw hole 931 of a locking base 93, such that the sliding stepping base 81 is slidably disposed on the two stepping rods 80, and the two sliding stepping bases 81 perform an elliptic movement according to the two stepping rods 80, so as to provide an elliptic exercise for exercising an exerciser's legs.

For the stepping exercise, the screw rod 83 of the locking rod 82 is locked into a screw hole 711 of a locking base 71. Now, the sliding stepping base 81 is not slidably disposed on a sliding rod 92 of the connecting mechanism 90. Therefore, the two sliding stepping bases 81 will operate with the sliding rod 92 to slide on the stepping rod 80 to provide a stepping exercise for exercising an exerciser's legs.

However, the prior art fitness machine concurrently having a stepping exercise and an elliptic exercise can provide exercisers for the legs only, but not for the arms. Therefore, such fitness machine cannot provide multiple functions and also cannot provide exercises for both arms and legs synchronously.

Therefore, the prior art fitness machine concurrently providing a stepping exercise and an elliptic exercise definitely demands further improvements.

The inventor of the present invention based on years of experience in the industry of fitness machines and related products to conduct extensive researches and experiments to improve the shortcomings of the prior art, and finally invented a fitness machine with elliptical and stepping functions in accordance with the present invention.

SUMMARY OF THE INVENTION

The primary objective of the present invention is to provide a fitness machine with elliptical and stepping functions to overcome the shortcomings of the prior art. In the fitness machine of the invention, if one end of two support rods is selectively fixed to a frame, a limit effect will be produced on two pedals, such that the two sliding rods drive two cranks to rotate and provide an elliptic exercise, and the limit effect on the two pedals will produce an up-and-down stepping exercise. If one end of the two support rods is fixed to the sliding rod, the limit effect to the pedals provided by each support rod will be diminished, so that the two pedals and the two support rods move synchronously, and the two pedals together with the two sliding rods will produce the corresponding elliptic exercise, and further produce a stepping exercise and an elliptic exercise for exercisers who work out on the fitness machine with elliptical and stepping functions.

Another objective of the present invention is to provide a fitness machine with elliptical and stepping functions, wherein the two swinging arms pivotally coupled to the vertical rod are coupled to the two sliding rods respectively. Regardless of the stepping exercise or the elliptic exercise, the two sliding rods will provide an elliptic movement, and thus the two swinging arms are linked by the two sliding rods and will be swung back and forth synchronously, and the fitness machine with elliptical and stepping functions of the invention not only provides exercises for the exerciser's legs, but also provides exercises for the exerciser's arms. The present invention provides a dual exercising effect.

The above and other objects, features and advantages of the present invention will become apparent from the following detailed description taken with the accompanying drawing.

DETAILED DESCRIPTION OF THE PREFERRED EMBODIMENTS

The present invention provides a design of a fitness machine with elliptical and stepping functions.

The structural design and technical characteristics of the present invention will become apparent in the following detailed description of the preferred embodiments with reference to FIGS. 1 to 9.

Figure 1:
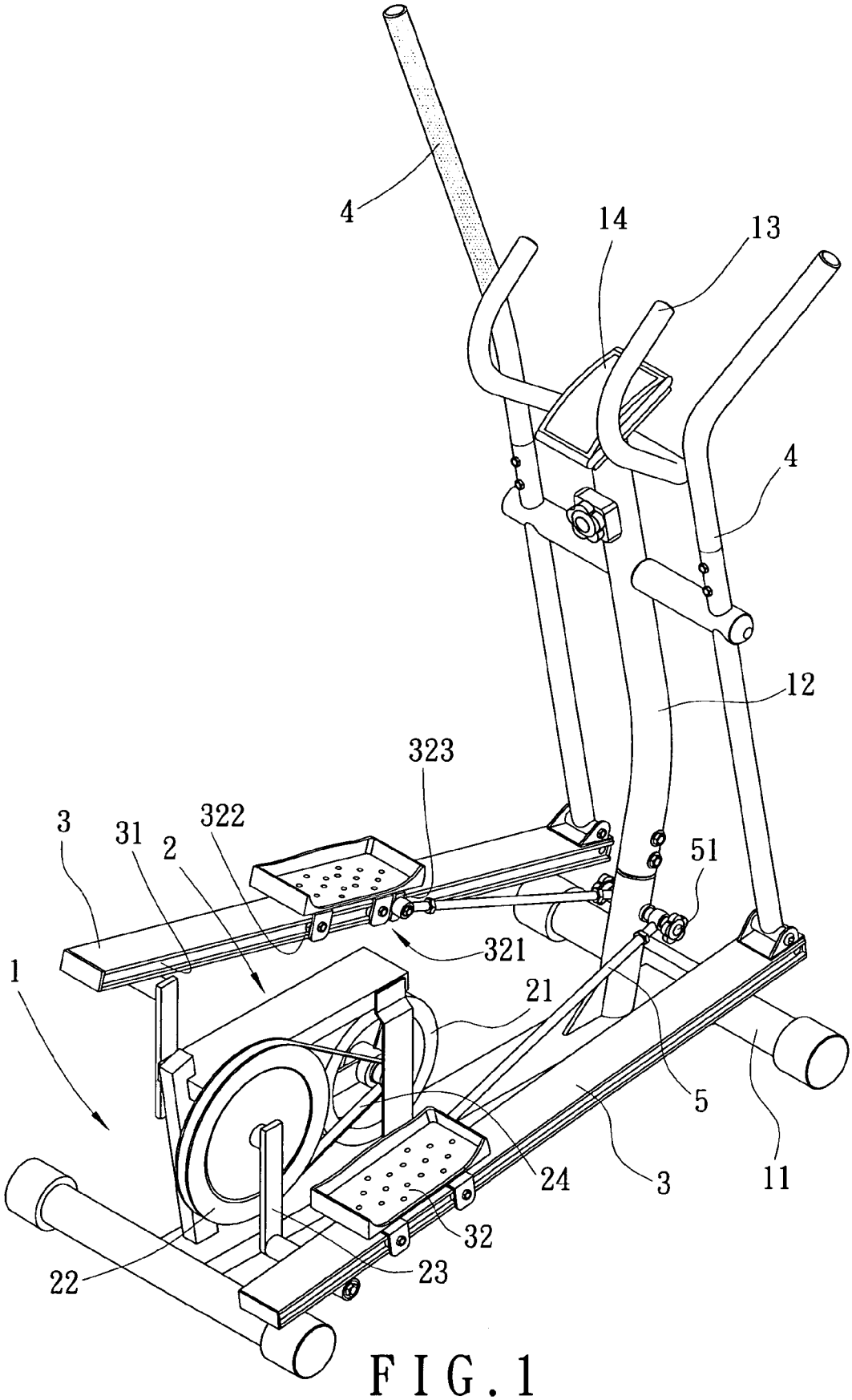
FIG. 1 is a perspective view of a fitness machine with elliptical and stepping functions of the present invention.

Referring to FIG. 1, a fitness machine with elliptical and stepping functions of the present invention comprises:

a frame 1, including a H-shape base 11 and a vertical rod 12, and the vertical rod 12 at its top edge includes a holding portion 13 and a counter 14;

a driving mechanism 2, including a magnetic load wheel 21, a flywheel 22, and a crank 23 disposed separately on both sides of the flywheel 22, and a transmission belt 24 disposed between the magnetic load wheel 21 and the flywheel 22 for linking the magnetic load wheel 21 and the flywheel 22;

two sliding rods 3, at their lower edges separately include a crank 23, and each sliding rod 3 includes a groove 31 separately on both sides and parallel to the sliding rod 3 for slidably installing the two pedals 32 to the two sliding rods 3 respectively, and the two pedals 32 include two roller sets 321 separately disposed at each groove 31 of each sliding rod 3, and each roller set 321 includes four rollers 322 separately disposed in each groove 31, such that each pedal 321 slides along each sliding rod 3, and each pedal 321 further includes a connecting plate 323, and each connecting plate 323 is L-shaped in this preferred embodiment;

two swinging arms 4, separately and pivotally coupled to both sides of the vertical rod 12 of the frame 1, and the bottoms of the two swinging arms 4 are coupled to the ends without the pedals 32 of the two sliding rods 3 respectively; and two support rods 5, having an end separately and pivotally coupled to the connecting plate 323 of the two pedals 32, and the other end selectively being fixed to both sides of the vertical rod 12 or each sliding rod 3, and each support rod 5 being selectively fixed to the vertical rod 12 or the sliding rod 3 by a screw bolt 51.

Figures 2, 3:
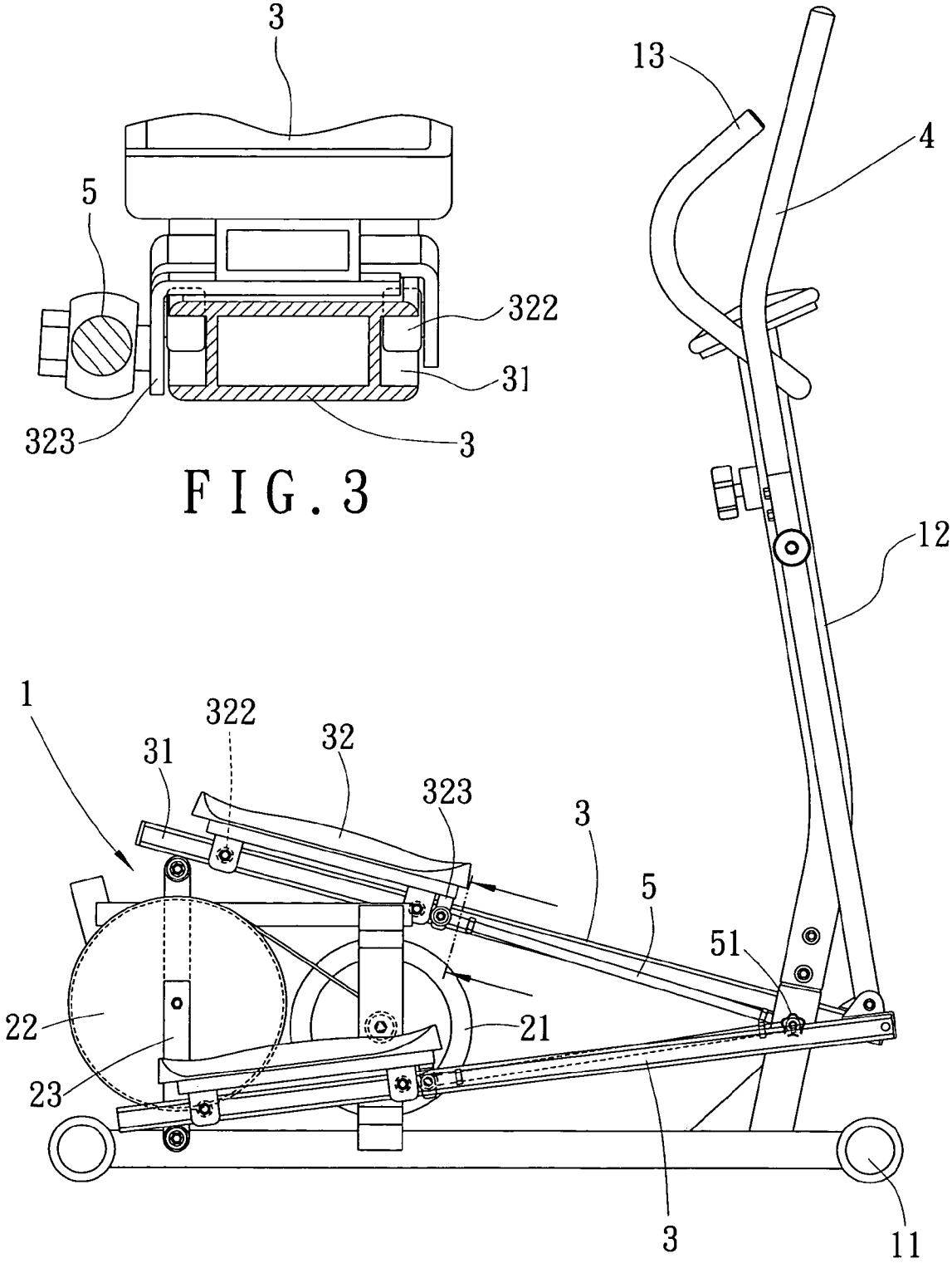
FIG. 2 is a side view of a fitness machine with elliptical and stepping functions and in a stepping mode according to the present invention.
FIG. 3 is a cross-sectional view of a sliding rod of a fitness machine with elliptical and stepping functions and in a stepping mode according to the present invention.
Figure 4:
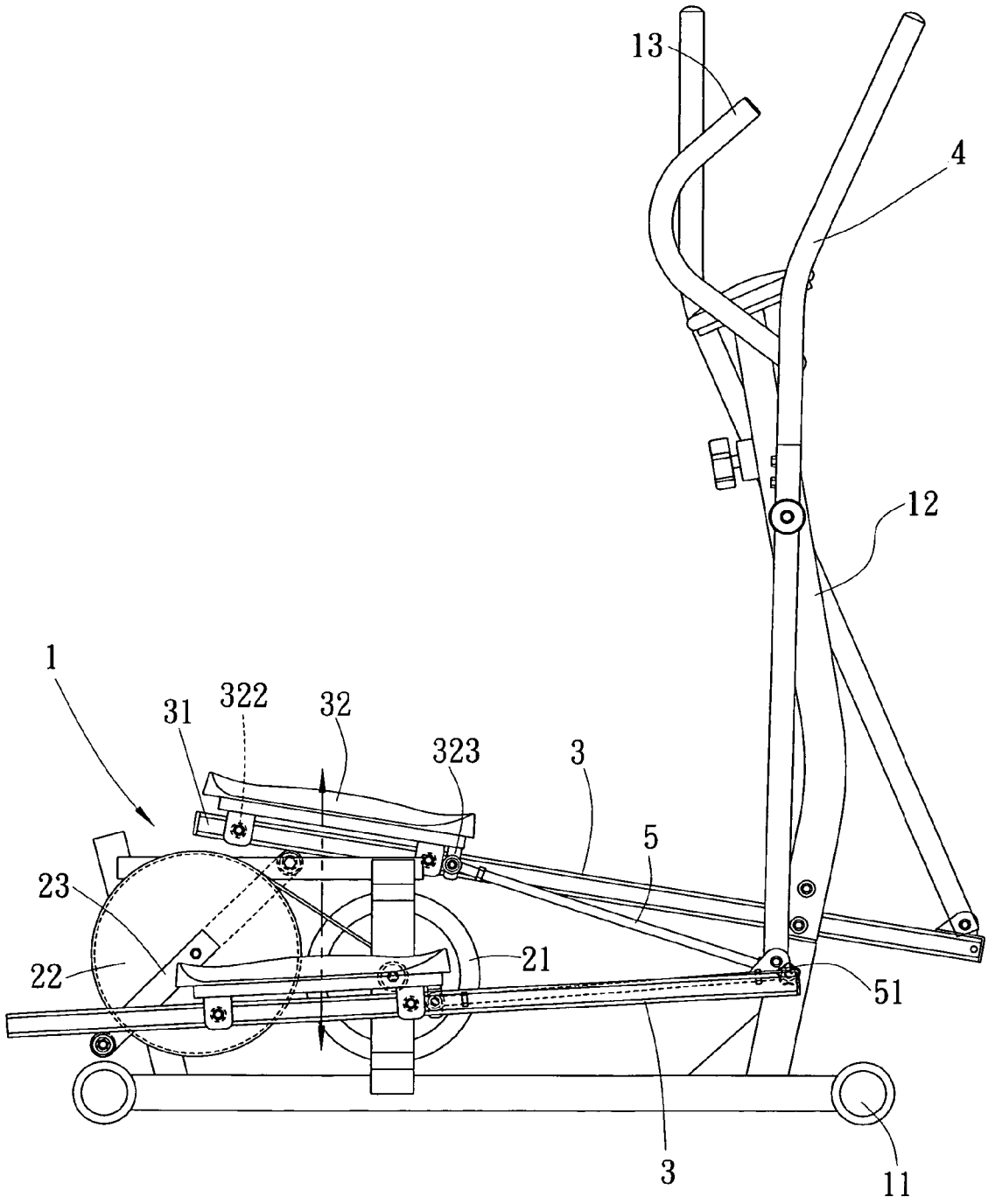
FIG. 4 is a schematic view of the movement of a fitness machine with elliptical and stepping functions and in a stepping mode according to the present invention.

In FIGS. 2 to 4, exercisers just need to selectively fix each support rod 5 to the vertical rod 12 for performing a stepping exercise on the fitness machine with elliptical and stepping functions. Now, each screw bolt 51 is used to secure the two support rods 5 separately to both sides of the vertical rod 12, so that the two support rods 5 produce a limit effect separately to the two pedals 32. Each roller 322 of each roller set 321 at the lower edge of the pedal 32 is accommodated separately in the two grooves 31 of each sliding rod 3, such that when an exerciser stands and exercises on the fitness machine with elliptic and stepping functions of the present invention, the exerciser steps on the two pedals 32, and the two sliding rods 3 drive the two cranks 23 to rotate correspondingly, and the two sliding rods 3 produce the corresponding elliptic exercise. Since the limit effect is applied on the two pedals 32 by the two support rods 5, and each pedal 32 includes a sliding rod 3 slidably disposed in each groove 31 of each roller 322, the two pedals 32 will not produce an elliptic movement according to the two sliding rods 3, but will produce an up-and-down movements for the stepping exercise instead.

Figure 5:
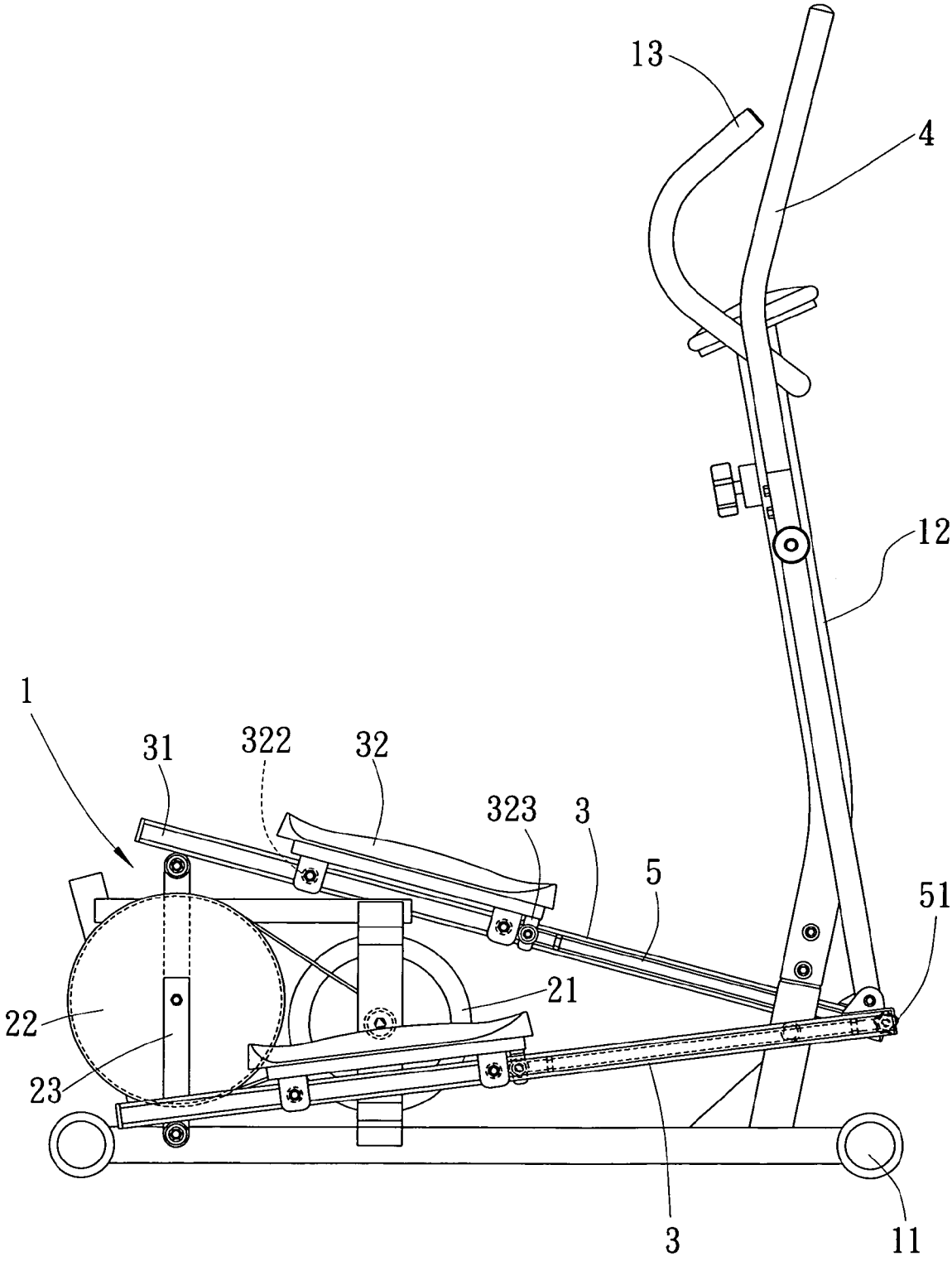
FIG. 5 is a side view of a fitness machine with elliptical and stepping functions being in an elliptic mode according to the present invention.
Figure 6:
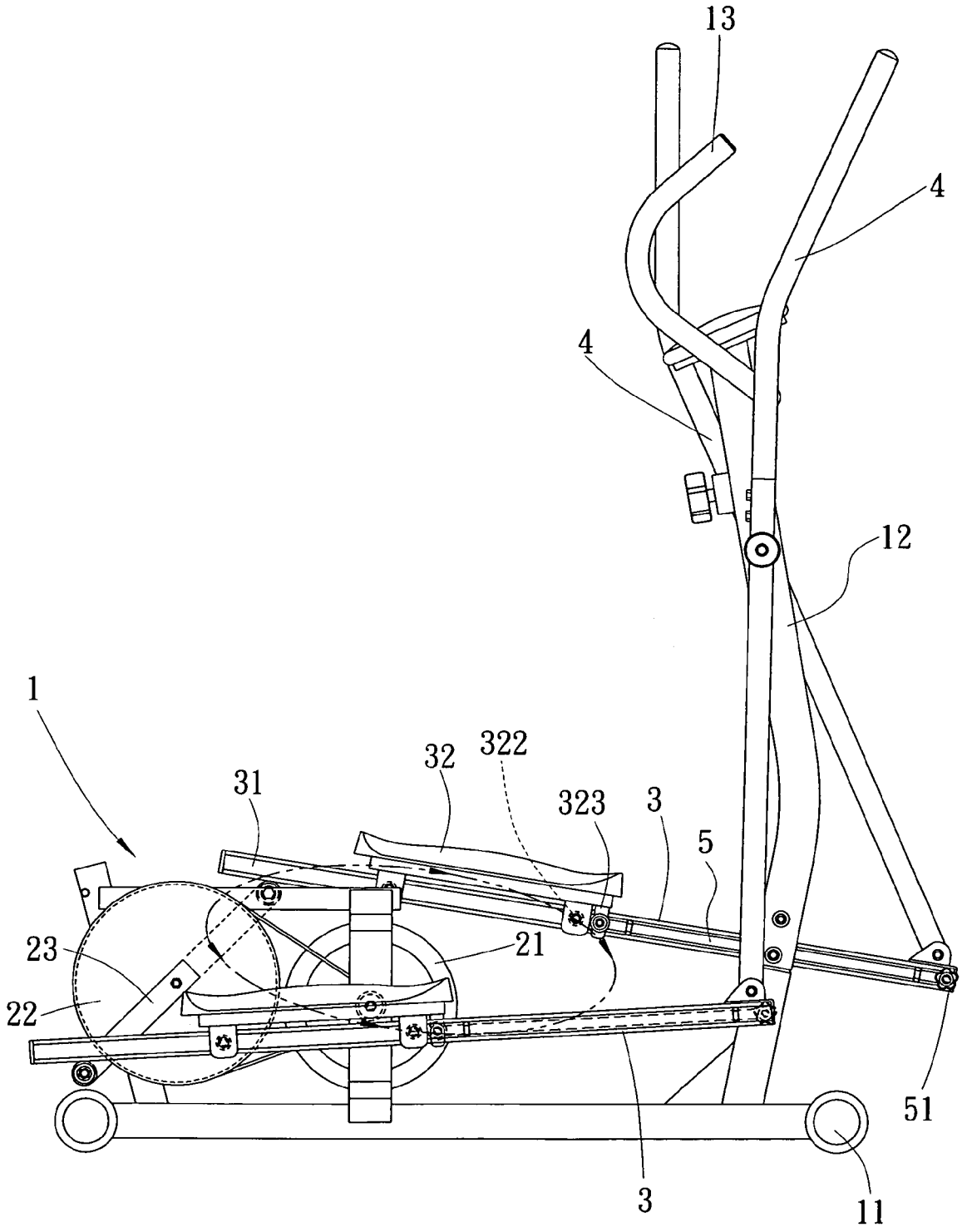
FIG. 6 is a schematic view of the movement of a fitness machine with elliptical and stepping functions and in an elliptic mode according to the present invention.
Figure 8:
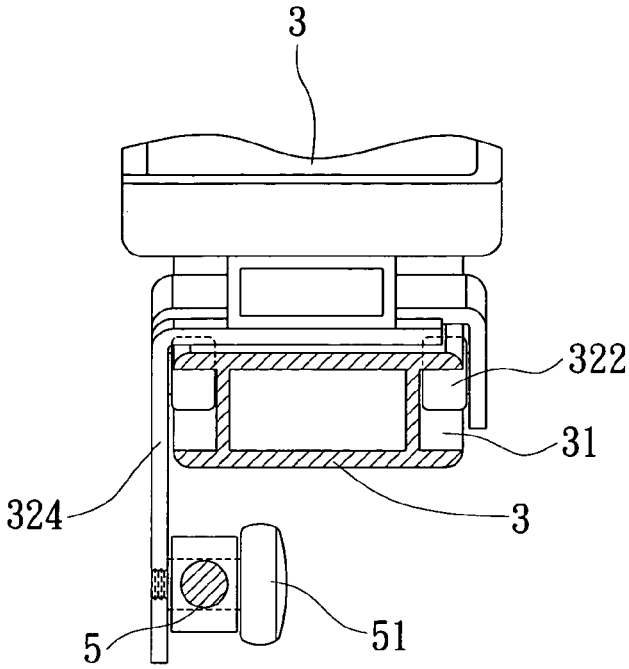
FIG. 8 is a cross-sectional view of a sliding rod of a fitness machine with elliptical and stepping functions according to another preferred embodiment of the present invention.

In FIGS. 5 and 6, if it is necessary to perform an elliptic exercise on the fitness machine with elliptical and stepping functions of the present invention, the exercise just needs to secure and fix the two support rods 5 of the vertical rod 12 and uses the two screw bolts 51 to secure the two sliding rods 3, such that the two pedals 32 are fixed to the two sliding rods 3. If the exerciser steps on the two pedals 32 to drive the two sliding rods 3 to rotate the two cranks 23 correspondingly, and thus the two sliding rods 3 produce the corresponding elliptic exercise. Now, the two support rods 5 are secured onto the two sliding rods 3, and thus the two pedals 32 together with the two sliding rods 3 will produce a corresponding elliptic exercise synchronously, such that the fitness machine can also provide the elliptic exercise.

Since the two swinging arms 4 are separately and pivotally coupled to both sides of the vertical rod 12, and the bottom of swinging arm 4 is coupled to an end of the two sliding rods 3 other than the end having the two pedals 32. Regardless of doing a stepping exercise or an elliptic exercise on the fitness machine of the present invention, the two sliding rods 3 will produce the corresponding elliptic exercise, so that when the two sliding rods 3 are moved correspondingly, the two swinging arms 4 are linked to swing back and forth. If an exerciser uses the fitness machine of the invention, the fitness machine not only exercises the exerciser's legs, but also exercises the exerciser's arms, so to have a dual exercising effect.

The driving mechanism 2 includes a flywheel 22, a magnetic load wheel 21, and a transmission belt 24 installed between the flywheel 22 and the magnetic load wheel 21, such that when the two pedals 32 are stepped to drive the two cranks 23, the flywheel 22 is driven synchronously and link the magnetic load wheel 21. The load produced by the magnetism of the magnetic load wheel 21 provides a resistance for increasing the level of exercise for the fitness machine of the present invention.

Figure 7:
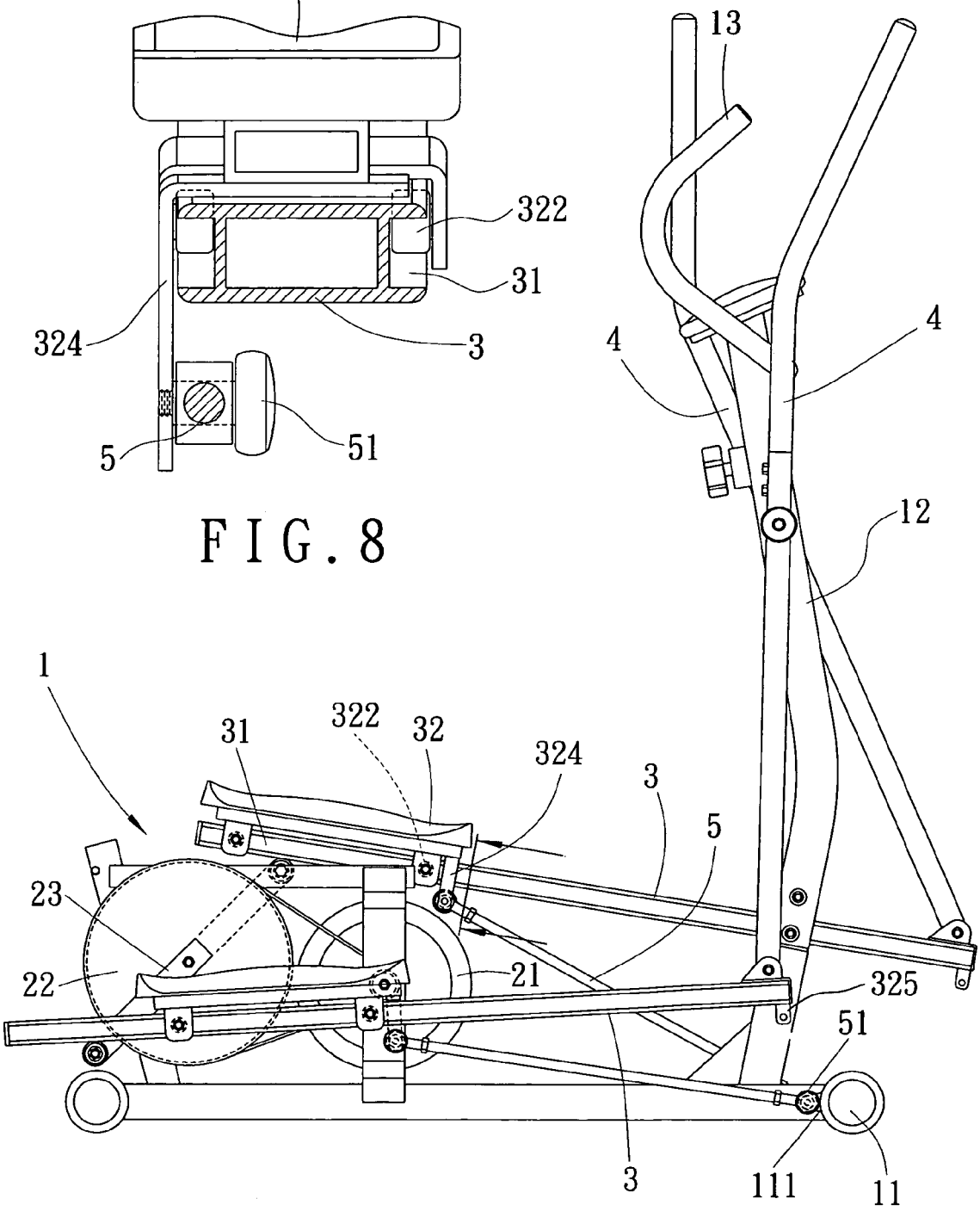
FIG. 7 is a side view of a fitness machine with elliptical and stepping functions and in a stepping mode according to another preferred embodiment of the present invention.
Figure 9:
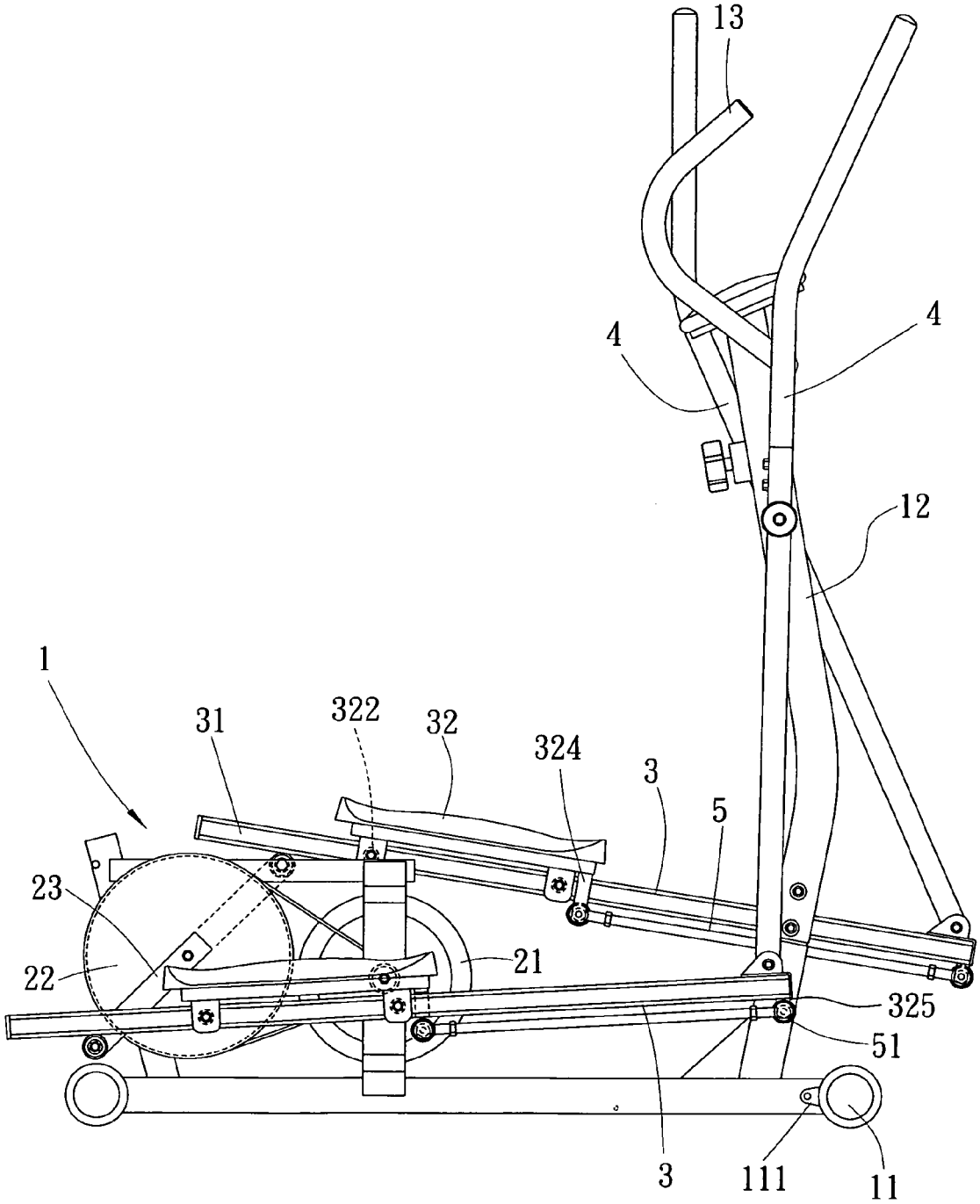
FIG. 9 is a side view of a fitness machine with elliptical and stepping functions and in an elliptic mode according to another preferred embodiment of the present invention.
Figure 10:
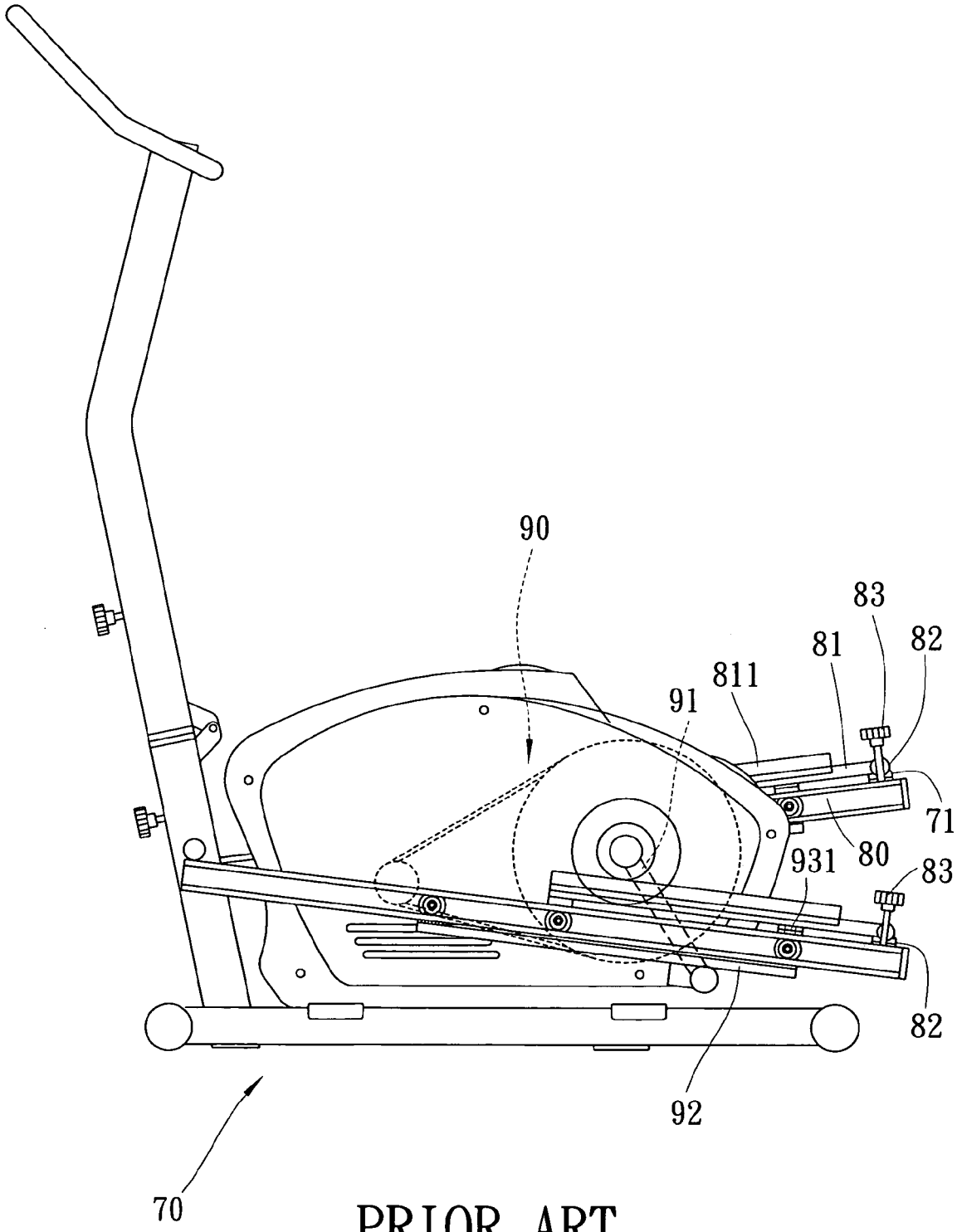
PRIOR ART FIG.10
FIG. 10 is a side view of a prior art fitness machine concurrently having stepping and elliptic exercise functions.
Figure 11:
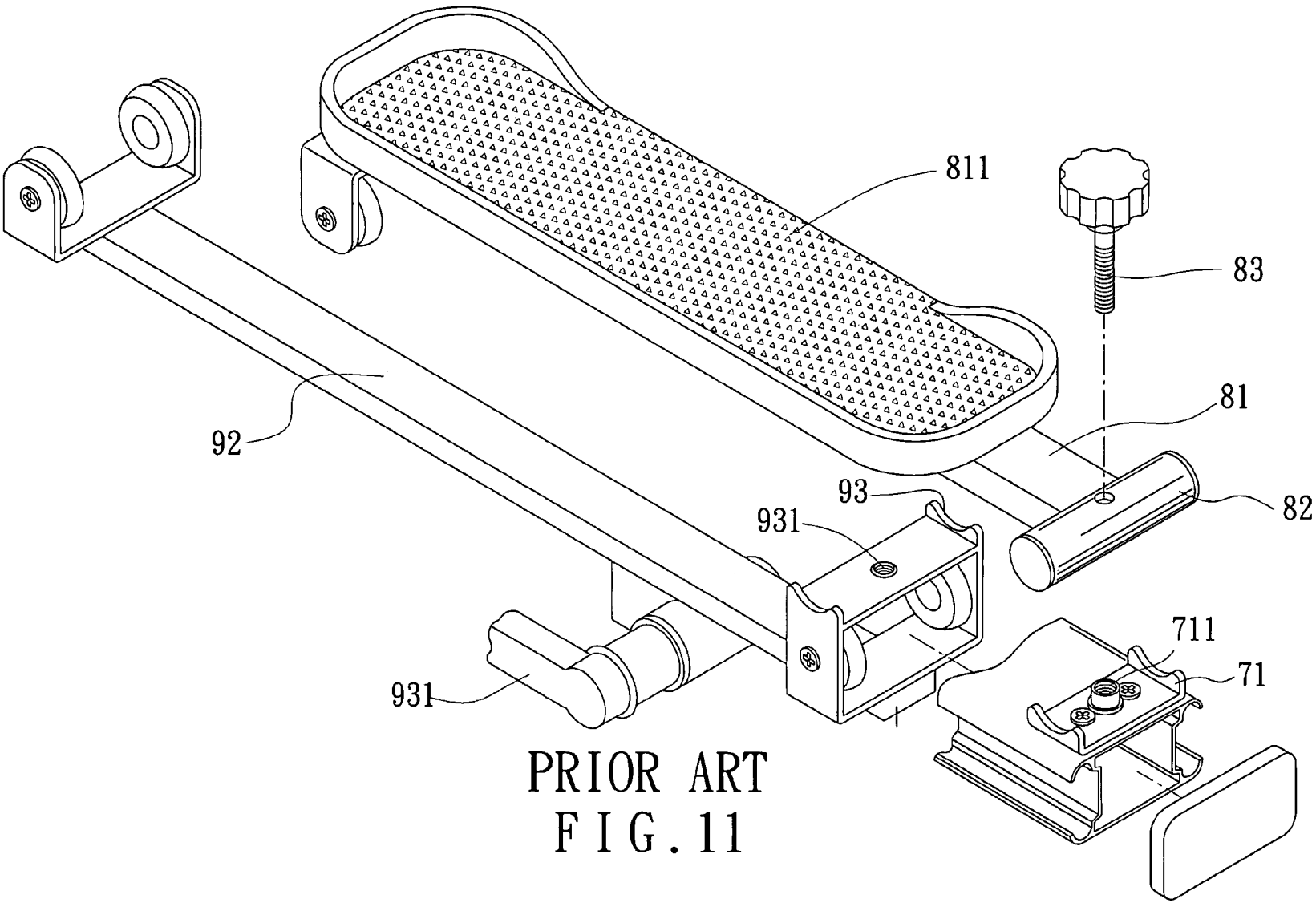
PRIOR ART FIG. 11
FIG. 11 is an exploded view of a prior art fitness machine concurrently having stepping and elliptic exercise functions.

Of course, minor modifications can be made to the present invention. Referring to FIGS. 7 and 9 for the second preferred embodiment of the present invention, the frame 1 comprises a base 11 and a vertical rod 12, and the base 11 includes two ears 111 protruded thereon, and each connecting plate 324 of the two pedals 32 is L-shaped in this preferred embodiment for connecting a sliding rod 3. Further the two sliding rods 3 at the end other than the end having the pedal 32 separately include a coupling plate 325, and each lower edge of the two connecting plate 324 is pivotally coupled to a support rod 5, and the end of each pedal 32 of each support rod 5 is secured and fixed by a screw bolt 51, and the end without the pedal 32 is pivotally coupled to the two ears 111 of the base 11 to define the stepping mode for the fitness machine. On the other hand, if it is necessary to change to an elliptic exercise mode of the fitness machine, the exerciser just needs to secure the two support rods 5 separately to the coupling plate 325 of the sliding rod 3.

In summation of the description above, the fitness machine with elliptical and stepping functions of the invention uses the change of the fixed position of the two support rods 5 to selectively provide a limit effect to the two pedals 32 by the two support rods 5, such that the two pedals 32 will be either synchronous or asynchronous with the two sliding rods 3 to produce dual exercise paths for the stepping exercise and the elliptic exercise. Regardless of the stepping exercise or the elliptic exercise, the two swinging arms 4 are linked by the two sliding rods 3 to swing back and forth. The invention improves over the prior art, and complies with the requirements of patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fitness machine with elliptical and stepping functions, comprising a frame, a driving mechanism, two sliding rods, and two swinging arms, the driving mechanism being pivotally coupled to the two sliding rods, such that the two sliding rods are driven by the driving mechanism to swing back and forth, the frame comprising a base and a vertical rod;

the two sliding rods separately include a pedal having a connecting plate, and two front ends of the two sliding rods separately and pivotally coupled to a swinging arm of the vertical rod;

the two support rods having one end separately and pivotally coupled to the connecting plate of the pedal, and the other end selectively fixed to the vertical rod or the sliding rod;

such that if one end of the two support rods is selectively fixed to the vertical rod, a limit effect will be produced on the two pedals, so that the two pedals move up and down for a stepping exercise, and if one end of the two support rods is fixed to the sliding rod, the limit effect on the pedal provided by the each support rod will be diminished to move the two pedals back and forth for an elliptic exercise, and regardless of the stepping exercise or the elliptic exercise, the two swinging arms are linked by the two sliding rods to swing back and forth, so as to define a fitness machine with elliptic and stepping functions.

2. The fitness machine with elliptical and stepping functions of claim 1, wherein the two sliding rods include a groove disposed separately on both sides of the two sliding rods.

3. The fitness machine with elliptical and stepping functions of claim 2, wherein the two pedals separately include a roller set disposed at the lower edge of the two pedals and the each roller set include four rollers separately disposed in the two grooves of the each pedal.

4. The fitness machine with elliptical and stepping functions of claim 1, wherein the driving mechanism comprises a magnetic load wheel, a flywheel, and a crank disposed separately on both sides of the crank.

5. The fitness machine with elliptical and stepping functions of claim 4, wherein the two cranks have a sliding rod separately.

6. The fitness machine with elliptical and stepping functions of claim 4, further comprising a transmission belt disposed between the magnetic load wheel and the flywheel.

7. The fitness machine with elliptical and stepping functions of claim 1, wherein the two support rods at ends without the two connecting plates are fixed to the vertical rod or the each sliding rod by a screw bolt.

8. The fitness machine with elliptical and stepping functions of claim 1, wherein the connecting plate is L-shaped.

9. A fitness machine with elliptical and stepping functions, comprising a frame, a driving mechanism, two sliding rods, and two swinging arms, and the driving mechanism being pivotally coupled to the two sliding rods, such that the two sliding rods are driven by the driving mechanism to swing back and forth, the frame comprising a base and a vertical rod, and the base includes two ears protruded thereon;

the two sliding rods separately including a pedal having a connecting plate, and two front ends of the two sliding rods being separately and pivotally coupled to a swinging arm of the vertical rod, and the lower edges of the front ends of the two sliding rods separately including a coupling plate;

the two support rods having one end separately and pivotally coupled to the lower edge of the connecting plate of the pedal, and the other end selectively fixed to the ear of the base or the coupling plate of the sliding rod;

such that if one end of the two support rods is selectively fixed to the front edge of the base, a limit effect will be produced on the two pedals, so that the two pedals move up and down for a stepping exercise, and if one end of the two support rods is fixed to the sliding rod, the limit effect on the pedal provided by the each support rod will be diminished to move the two pedals back and forth for an elliptic exercise, and regardless of the stepping exercise or the elliptic exercise, the two swinging arms are linked by the two sliding rods to swing back and forth, so as to define a fitness machine with elliptic and stepping functions.

10. The fitness machine with elliptical and stepping functions of claim 9, wherein the connecting member is L-shaped.

11. The fitness machine with elliptical and stepping functions of claim 9, wherein the two sliding rods include a groove disposed separately on both sides of the two sliding rods.

12. The fitness machine with elliptical and stepping functions of claim 11, wherein the two pedals separately include two roller sets disposed at the lower edge of the two pedals and the each roller set includes four rollers separately disposed in the two grooves of the each pedal.

13. The fitness machine with elliptical and stepping functions of claim 9, wherein the driving mechanism comprises a magnetic load wheel, a flywheel, and a crank disposed separately on both sides of the crank.

14. The fitness machine with elliptical and stepping functions of claim 13, wherein the two cranks are separately coupled to a sliding rod.

15. The fitness machine with elliptical and stepping functions of claim 13, further comprising a transmission belt disposed between the magnetic load wheel and the flywheel.

16. The fitness machine with elliptical and stepping functions of claim 9, wherein the two support rods at ends without the two connecting plates are fixed to an ear of the base or a coupling plate of the each sliding rod by a screw bolt.

* * * * *